US009731923B2

(12) United States Patent
Ishikawa

(10) Patent No.: US 9,731,923 B2
(45) Date of Patent: Aug. 15, 2017

(54) MEDIUM TRANSPORT METHOD, MEDIUM TRANSPORT DEVICE, AND IMAGE RECORDING DEVICE

(71) Applicant: Seiko Epson Corporation, Tokyo (JP)

(72) Inventor: Toshiaki Ishikawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/838,620

(22) Filed: Aug. 28, 2015

(65) Prior Publication Data

US 2016/0067986 A1 Mar. 10, 2016

(30) Foreign Application Priority Data

Sep. 4, 2014 (JP) ..... 2014-179916

(51) Int. Cl.
*B65H 20/02* (2006.01)
*B65H 16/10* (2006.01)
*B41J 15/04* (2006.01)

(52) U.S. Cl.
CPC ..... *B65H 20/02* (2013.01); *B41J 15/046* (2013.01); *B65H 16/103* (2013.01); *B65H 2301/331* (2013.01); *B65H 2301/4134* (2013.01); *B65H 2301/41461* (2013.01); *B65H 2301/5151* (2013.01); *B65H 2404/1441* (2013.01); *B65H 2404/742* (2013.01); *B65H 2511/11* (2013.01); *B65H 2553/414* (2013.01); *B65H 2701/1311* (2013.01); *B65H 2801/36* (2013.01)

(58) Field of Classification Search
CPC ..... B65H 20/02; B65H 16/103; B65H 2301/41461; B65H 2553/414; B65H 2404/742; B65H 2511/11; B65H 2404/1441; B65H 2801/36; B65H 2301/331; B65H 2301/5151; B65H 2301/4134; B65H 2701/1311; B41J 15/046
See application file for complete search history.

(56) References Cited

U.S. PATENT DOCUMENTS 5,951,181 A * 9/1999 Hierro ..... B41J 11/005 271/264
6,626,343 B2 * 9/2003 Crowley ..... B41J 11/0005 226/171
2002/0090245 A1 * 7/2002 Fujioka ..... B41J 11/0005 400/642
2010/0061783 A1 3/2010 Kawasaki et al.
2011/0110698 A1 * 5/2011 Yamanaka ..... B41J 13/103 400/578
2012/0098190 A1 * 4/2012 Nieda ..... B41J 11/0045 271/265.01

FOREIGN PATENT DOCUMENTS

JP 2003-112453 A 4/2003
JP 2010-064820 A 3/2010
JP 2012-076902 A 4/2012
JP 2012-162343 A 8/2012

* cited by examiner

*Primary Examiner* — Bradley Thies
(74) *Attorney, Agent, or Firm* — Workman Nydegger

(57) ABSTRACT

A medium transport method, which is performed by a medium transport device having a transport unit which includes rollers that can pinch a medium and which transports the medium, includes inserting the medium to a predetermined position, pressing a side end portion of the medium against a side surface guide, and pinching the medium with the rollers, and transports the medium.

4 Claims, 5 Drawing Sheets

MEDIUM TRANSPORT METHOD, MEDIUM TRANSPORT DEVICE, AND IMAGE RECORDING DEVICE

BACKGROUND

1. Technical Field

The present invention relates to a medium transport method, a medium transport device, and an image recording device.

2. Related Art

A recording device that can record on a roll paper (medium) supplied in a rolled state has been known. Once a medium such as a roll paper is set in a recording device, it is possible to supply a large amount of paper. Therefore, a recording device shown in JP-A-2003-112453 includes a paper feed mechanism that automatically feeds a roll paper and a cutter device that automatically cuts paper after recording, so that the amount of manual operation performed by a user is reduced and operating efficiency is improved.

However, an automatic paper feed mechanism according to JP-A-2003-112453 has a risk to cause a skew where a paper is obliquely fed when a roll paper whose tip is obliquely cut is fed. Specifically, when the tip of the roll paper is nipped by transport rollers, the rollers are driven at a constant rotation speed. When a portion that is first nipped at the tip of the roll paper is one end of the tip, a paper transporting force is concentrated around the one end and the paper may be obliquely fed. The recording device of JP-A-2003-112453 uses a roll paper that is cut by a cutter device included in the recording device, so that a risk that a skew is generated is small. However, when using another cutter device or a roll paper that is manually cut, there is a risk that a skew is generated, so that further improvement is required.

SUMMARY

An advantage of some aspects of the invention is to provide a medium transport method that can feed a medium while suppressing generation of skew without being affected by the tip shape of the medium when feeding the medium including a roll paper.

To solve at least a part of the problems described above, the invention can be realized as the aspects or application examples described below.

Application Example 1

A medium transport method according to the present application example is performed by a medium transport device having a transport unit which includes rollers that can pinch a medium and which transports the medium. The medium transport method is characterized by including pressing a side end portion of the medium against a side surface guide and pinching the medium with the rollers.

According to the present application example, the side end portion of the medium is positioned by the side surface guide and thereafter the medium is pinched by the rollers. Even when the tip of the medium is cut obliquely, it is possible to feed the medium without being affected by the tip shape of the medium. Further, the side end portion of the medium is positioned by the side surface guide, so that it is possible to suppress generation of skew. Therefore, it is possible to provide a medium transport method that can feed a medium while suppressing generation of skew without being affected by the tip shape of the medium when feeding the medium.

Application Example 2

A medium transport method according to the present application example is characterized by including inserting the medium into the transport unit, putting the rollers into an unpinching state after detecting a tip of the medium inserted in the inserting the medium into the transport unit, and inserting the medium to a predetermined position.

According to the present application example, the unpinching state is established after the medium is detected in the inserting the medium into the transport unit, and a pinching state is released, so that it is possible to prevent erroneous feeding of the medium or erroneous insertion of something other than a medium.

Application Example 3

A medium transport method according to the present application example is characterized by including checking whether the medium is inserted to the predetermined position located more downstream than the rollers after the inserting the medium to the predetermined position.

According to the present application example, it is possible to reliably insert the medium to a predetermined position, so that it is possible to more accurately feed the medium.

Application Example 4

The checking whether the medium is inserted to the predetermined position in the medium transport method according to the present application example is characterized by being performed based on information inputted by a user.

According to the present application example, an opportunity for a user to confirm the position of the medium is provided, so that it is possible to reliably feed the medium.

Application Example 5

At least one of the inserting the medium to a predetermined position, the inserting the medium into the transport unit, and the pressing a side end portion of the medium against a side surface guide in a medium transport method according to the present application example is characterized by being performed manually by a user.

According to the present application example, an opportunity for a user to confirm and operate the medium is provided, so that it is possible to reliably feed the medium.

Application Example 6

A medium transport device according to the present application example is characterized by including a transport unit which includes rollers that can pinch a medium and which transports the medium and a side surface guide against which a side end portion of the medium is pressed, and is characterized in that the transport unit pinches the medium in a state in which the side end portion of the medium is pressed against the side surface guide.

According to the present application example, it is possible to provide a medium transport device that can feed a medium while suppressing generation of skew without being affected by the tip shape of the medium when feeding the medium.

Application Example 7

The image recording device according to the present application example is characterized by including the medium transport device and an image recording unit that records an image on the medium.

According to the present application example, it is possible to provide an image recording device that can feed a medium while suppressing generation of skew without being affected by the tip shape of the medium when feeding the medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
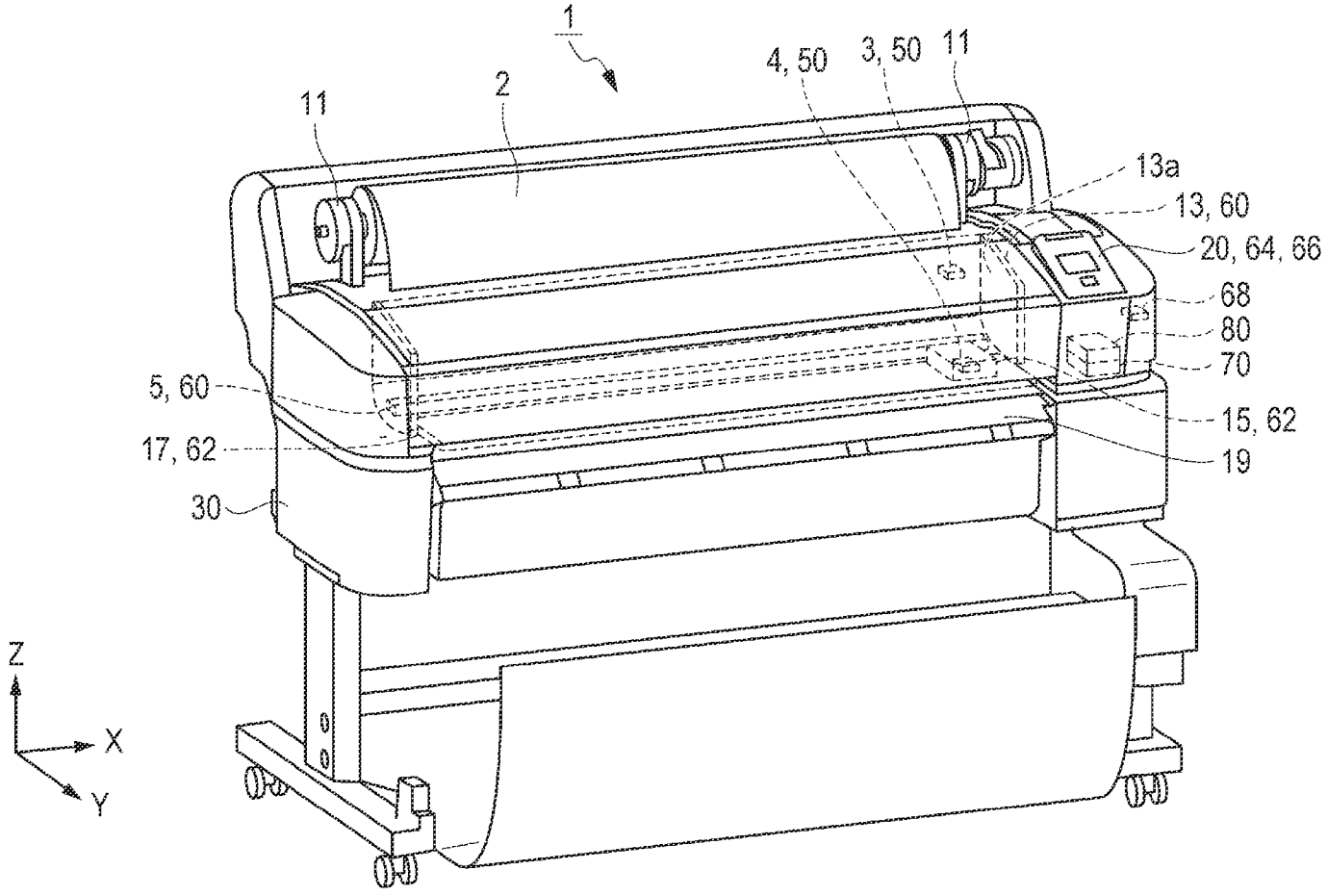
FIG. 1 is a perspective view schematically showing an external appearance of a printer.

Hereinafter, embodiments that incorporate the invention will be described with reference to the drawings. The followings are embodiments of the invention and do not limit the invention. In the drawings described below, a scale different from the actual scale may be used for ease of explanation.

First Embodiment

Overview of Printer 1

FIG. 1 is a perspective view schematically showing an external appearance of a printer 1.

The printer 1 is, for example, a large ink jet type printer that can record an image including characters and drawings on a print medium having a relatively large size such as A0 or B0 of JIS standard. A roll paper 2 is an example of the print medium and is supplied in a state of being wound like a roll. The print medium corresponds to a medium.

In a coordinate system used in each drawing, in a state in which the roll paper 2 is loaded in the printer 1, the width direction of the roll paper 2 is defined as an X axis direction, and a direction which is perpendicular to the X axis direction and in which the roll paper is transported is defined as a Y axis direction. Further, a direction perpendicular to X-Y plane is defined as a Z axis direction.

A device main body 30 of the printer 1 includes a sensor 3, a sensor 4, transport rollers 5, a roll paper adaptor 11, a paper guide 13, a carriage 15, a platen 17, a discharge unit 19, an operation panel 20, a communication unit 68, a storage unit 70, and a control unit 80.

The sensor 3 and the sensor 4 are component parts included in a sensor unit 50. The transport rollers 5 and the paper guide 13 are component parts included in a transport drive unit 60. The platen 17 and the carriage 15 are component parts included in a printing unit 62. The operation panel 20 is a component having functions of both an operation unit 64 and a notification unit 66.

The printer 1 corresponds to an image recording device. In the printer 1, a component including the roll paper adaptor 11 that transports the roll paper 2, the discharge unit 19, the operation unit 64, the notification unit 66, the sensor unit 50, the transport drive unit 60, the communication unit 68, the storage unit 70, and the control unit 80 corresponds to a medium transport device.

The roll paper adaptor 11 is an adaptor part that is attached to both ends of a core of the roll paper 2. The roll paper adaptor 11 causes the roll paper 2 to be able to rotate smoothly in a state in which the roll paper adaptor 11 is attached to the roll paper 2. The roll paper adaptor 11 has a driven shaft structure. When a rotating part of the roll paper adaptor 11 is manually rotated, paper is sent out in a downstream direction of a transport path. When the paper is continuously and normally transported, the paper is pulled by a driving force of the transport drive unit 60 described later, the roll paper adaptor 11 is rotated by the force that pulls the paper, and the paper is supplied. The roll paper adaptor 11 also performs a braking action that controls the rotation so that slack does not occur in the paper supplied from the roll paper 2.

The transport drive unit 60 includes the paper guide 13, the transport rollers 5, and the like.

The paper guide 13 is a guide member which extends in a transport direction and includes a wall surface 13*a*. The paper guide 13 is arranged so that the wall surface 13*a* faces the center of the device main body 30. The wall surface 13*a* is a surface in parallel with a Y-Z plane and is arranged to be at the same position as that of a side end portion of the roll paper 2 loaded onto the roll paper adaptor 11 at a position on the X axis. Due to this arrangement, it is possible to feed the roll paper 2 without skew by pressing the side end portion of the sent-out roll paper 2 to come into contact with the wall surface 13*a*. The paper guide 13 corresponds to a side surface guide.

Figure 2:
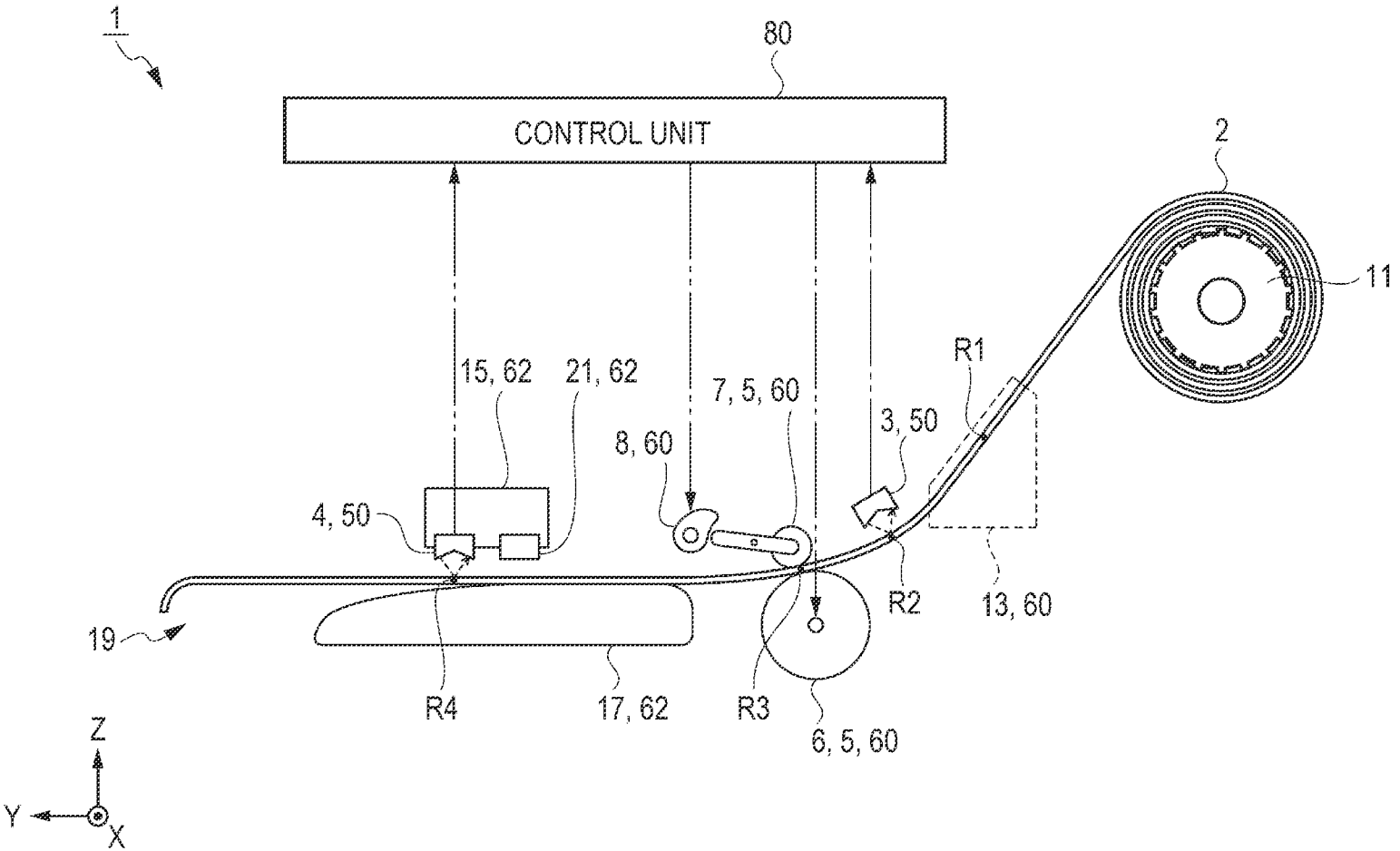
FIG. 2 is a conceptual diagram showing a transport path of a medium.

The transport rollers 5 include a pair of rollers that pinch and transport the paper sent out from the roll paper 2. The transport roller 5 is a roller having a cylindrical shape whose central axis is an axis line in parallel with the X axis. One of the pair of rollers is a drive roller 6 (FIG. 2) and the other is a driven roller 7 (FIG. 2). When the roll paper 2 is nipped, the roll paper 2 is pressed from the driven roller 7 and the roll paper 2 is transported to the downstream side in the transport direction at a constant pitch by drive of the drive roller 6. The details of control of the transport rollers 5 will be described later with reference to FIG. 2.

The sensor unit 50 includes the sensor 3 and the sensor 4. Each of the sensor 3 and the sensor 4 is formed by an optical sensor including a light emitting element and a light receiving element, receives reflection of light emitted from the light emitting element by the light receiving element, and detects the amount of received light. The sensor 3 and the sensor 4 detect the presence or absence of the roll paper 2 by using a phenomenon in which the light reflectance varies depending on the presence or absence of an object being located in a direction in which the light is emitted. Specifically, the sensor 3 and the sensor 4 detect that the roll paper 2 is present when the amount of received light of the reflected light exceeds a predetermined threshold value (reflectance). The sensor 3 or the sensor 4 detects the presence of the roll paper 2 when the paper of the roll paper 2 is transported in the transport path and the tip of the paper enters a detection range of the sensor 3 or the sensor 4. When the sensor 3 or the sensor 4 detects the roll paper 2, the sensor that detects the roll paper 2 outputs a detection signal to the control unit 80. The sensor 3 is arranged at a position more upstream than the transport rollers 5 in the transport direction, and the sensor 4 is arranged in the carriage 15 provided at a position more downstream than the transport rollers 5 in the transport direction. It is preferable that the sensor 3 and the sensor 4 are configured to be able to detect the entire length of the roll paper 2 in the width direction or a plurality of the sensors 3 and the sensors 4 are arranged in the width direction to be able to detect the roll paper 2 in a wide range in the width direction. Thereby, it is possible to reliably detect the roll paper 2 even when the tip of the roll paper 2 is cut obliquely.

The printing unit 62 includes the carriage 15, the platen 17, and the like. The carriage 15 includes a head 21 (FIG. 2) that discharges a plurality of colors of inks. The carriage 15 discharges inks while reciprocating in the X axis direction (the main scanning direction) and forms an image on a surface of the roll paper 2. The platen 17 extends in a range corresponding to a moving range of the carriage 15 in the X axis direction. The platen 17 supports the roll paper 2, which is being transported, from below and causes the roll paper 2 to move smoothly.

The printing unit 62 corresponds to an image recording unit.

The discharge unit 19 is a discharge outlet from which the roll paper 2 on which an image or the like has been printed is discharged. The discharge unit 19 is provided with a cutter device (not shown in the drawings) for cutting off the roll paper 2 after being printed for each printed image.

The operation panel 20 is an input device and a display device, which have functions of the operation unit 64 and the notification unit 66.

The operation unit 64 is an input device such as a touch panel and button switches. The operation unit 64 outputs an input signal inputted by an operation of a user to the control unit 80. The operation panel 20 includes a touch panel and outputs a selected input signal of the touch panel to the control unit 80.

The notification unit 66 is a display device such as a liquid crystal display and an LED (Light Emitting Diode) and an audio output device such as a speaker and a buzzer. The notification unit 66 notifies a user of various types of information by control of the control unit 80. The operation panel 20 includes a liquid crystal display and various screen data are displayed by control of the control unit 80. It is possible to issue various alarms to a user by light emission of an LED, ringing of a buzzer, and the like, and transmit information to a user in a more easy to understand manner by outputting audio data by a speaker or the like.

The communication unit 68 is a wireless LAN (Local Area Network) or the like. The communication unit 68 receives an original image data to be printed and transmits/receives various commands and other data to/from an external information device or the like by using IP (Internet Protocol). The communication unit 68 may be configured to connect to an external device which includes a physical communication terminal and has a common communication protocol through a cable and transmit/receive various data to/from the external device.

The storage unit 70 is a storage device such as a ROM (Read Only Memory), a flash ROM, and a RAM (Random Access Memory), and is configured to include a work area (not shown in the drawings) that temporarily stores display screen data to be displayed on a liquid crystal panel of the operation panel 20, a program which is read by the control unit 80 and is to be executed to realize various functions, data being processed of each processing executed by the control unit 80 and a result of the processing, and the like.

The control unit 80 includes an arithmetic processing unit including a CPU (Central Processing Unit), a ROM (Read Only Memory), a RAM (Random Access Memory), an NVRAM (Non Volatile Random Access Memory), and an EEPROM (Electrically Erasable Programmable Read Only Memory), a volatile memory, a non-volatile memory, and the like. The control unit 80 may be an ASIC including these described above. The control unit 80 controls the operation panel 20, the sensor unit 50, the transport drive unit 60, the printing unit 62, the communication unit 68, the storage unit 70, and the like of the printer 1 and realizes various functions. Functional units that realize various functions will be described later with reference to FIGS. 2 and 3.

Explanation of Transport Path

FIG. 2 is a conceptual diagram showing a transport path of a medium. The conceptual diagram shown in FIG. 2 shows main components related to a transport path in the printer 1 as a conceptual diagram seen from a side surface of the printer 1 (seen in the X axis direction).

The main components are the control unit 80, the roll paper 2, the roll paper adaptor 11, a transport drive unit 60, a sensor unit 50, a printing unit 62, a discharge unit 19, and the like, which are described in FIG. 1.

The sensor unit 50 includes the sensor 3 and the sensor 4. The printing unit 62 includes the carriage 15, the head 21, and the platen 17.

The transport drive unit 60 includes the paper guide 13, the transport roller 5, and a cam 8. The transport rollers 5 include the driven roller 7 and the drive roller 6.

The drive roller 6 rotates along with drive of a motor (not shown in the drawings) controlled by the control unit 80.

The cam 8 includes a cam component having a disk cam structure and a support component that vertically moves the driven roller 7. The cam 8 converts rotation power generated in a main shaft of the cam component by being driven and controlled by the control unit 80 into vertical power and vertically moves the entire driven roller 7 by using the support component. To adjust pressure after the vertical movement, a pressure adjusting spring mechanism may be used.

When the driven roller 7 is moved downward, the driven roller 7 and the drive roller 6 come into contact with each other, and when the roll paper 2 is located between the driven roller 7 and the drive roller 6, the roll paper 2 is pinched. When the driven roller 7 is moved upward, the driven roller 7 and the drive roller 6 are separated from each other. The shapes and the shaft positions of the cam component and the support component of the cam 8 are adjusted so that the clearance of the separation is increased to a length greater than the thickness of the roll paper 2.

In a state in which paper of the roll paper 2 in not loaded (an initial state), the driven roller 7 of the transport rollers 5 is moved down, and the drive roller 6 and the driven roller 7 are in contact with each other.

The control unit 80 controls each unit such as the sensor unit 50 and the transport drive unit 60 over the transport path and transports the paper of the roll paper 2 (upper right in FIG. 2) wound like a roll to the discharge unit 19 through a path R1, a path R2, a path R3, and a path R4. Hereinafter, a process in which the tip of the paper of the roll paper 2 is transported to each path point (R1 to R4) will be described.

The tip of the roll paper is sent out when the roll paper adaptor 11 rotates, and the tip of the roll paper moves to the path R1. In the path R1, the tip of the roll paper 2 comes into contact with the paper guide 13 and is smoothly guided in a direction toward the path R2. It is possible to rotate the roll paper adaptor 11 not only by using a power source such as a motor, but also by a user who manually rotates the roll paper adaptor 11.

When the tip of the roll paper 2 moves to the path R2, the presence of the tip of the paper is detected by the sensor 3 controlled by the control unit 80. When a detection signal is outputted from the sensor 3 to the control unit 80, the control unit 80 controls the transport drive unit 60 to rotate the cam 8 and move the driven roller 7 upward. The transport rollers 5 are separated from each other and a gap greater than the thickness of the roll paper 2 is generated between the driven roller 7 and the drive roller 6.

While the transport rollers 5 are separated from each other, the tip of the roll paper 2 is moved to the path R3 and passes through the gap between the transport rollers 5. Specifically, the rotation of the roll paper adaptor 11 is continued, so that the tip of the paper passes through between the driven roller 7 and the drive roller 6 by a pushing force by which the tip of the paper is pushed out and a dropping of the paper due to its own weight.

When the tip of the roll paper 2 moves to the path R4, the presence of the tip of the paper is detected by the sensor 4 controlled by the control unit 80. When a detection signal is outputted from the sensor 4 to the control unit 80, the control unit 80 displays a screen suggesting to confirm a paper feed state of the roll paper 2 on the operation panel 20 (for example, the screen shown in FIG. 4). The details of FIG. 4 will be described later.

The path 4 corresponds to a predetermined position.

After the screen suggesting to confirm the paper feed state of the roll paper 2 is displayed on the operation panel 20, when it is confirmed that the roll paper 2 is normally fed without skew as a result of confirmation of the paper feed state of the roll paper 2, the control unit 80 controls the transport drive unit 60 to rotate the cam 8 and move the driven roller 7 downward. The roll paper 2 is pinched by the transport rollers 5. Continuously, the control unit 80 controls the transport drive unit 60 to drive the drive roller 6. The roll paper 2 is transported by the transport rollers 5. The control unit 80 moves the carriage 15 in the main scanning direction in synchronization with the drive of the drive roller 6 and causes the head 21 to discharge inks. The roll paper 2 on which an image is printed is discharged from the discharge unit 19.

In this way, the control unit 80 determines that the tip of the paper of the roll paper 2 is inserted by receiving the detection signal outputted from the sensor 3 in the path R2. This situation is a state in which paper is continuously sent from the roll paper 2.

The control unit 80 causes the transport rollers 5 to separate from each other and enables the tip of the paper of the roll paper 2 to be sent deeply into the printer 1. In the path R3, the tip of the paper passes through a gap greater than the thickness of the roll paper 2, so that even when the tip of the paper of the roll paper 2 has any shape, it is possible to cause the roll paper 2 to pass through the gap. This situation is a state in which paper is continuously further sent from the roll paper 2.

At a time point when the tip of the paper of the roll paper 2 reaches the path R4, the transport rollers 5 are still separated from each other, so that it is possible to move and adjust the position of the paper in the left-right direction. A user can confirm again the position of the roll paper 2 in the path R1 and cause a side surface of the roll paper 2, which passes through the path R1, to come into contact with the paper guide 13 so that the side surface of the roll paper 2 is pressed against the paper guide 13.

When the control unit 80 can confirm the paper feed state, the control unit 80 controls the transport rollers 5 to pinch the roll paper 2 and starts transport. The entire length of the roll paper 2 in the paper width direction (the X axis direction) is equally pinched by the transport rollers 5 and the roll paper 2 is transported by the transport rollers 5.

By such a transport method, whatever the shape of the tip of the roll paper 2 may be, it is possible to easily adjust the position of the paper without being affected by the shape of the tip and to suppress generation of skew.

Functional Configuration of Printer 1

Figure 3:
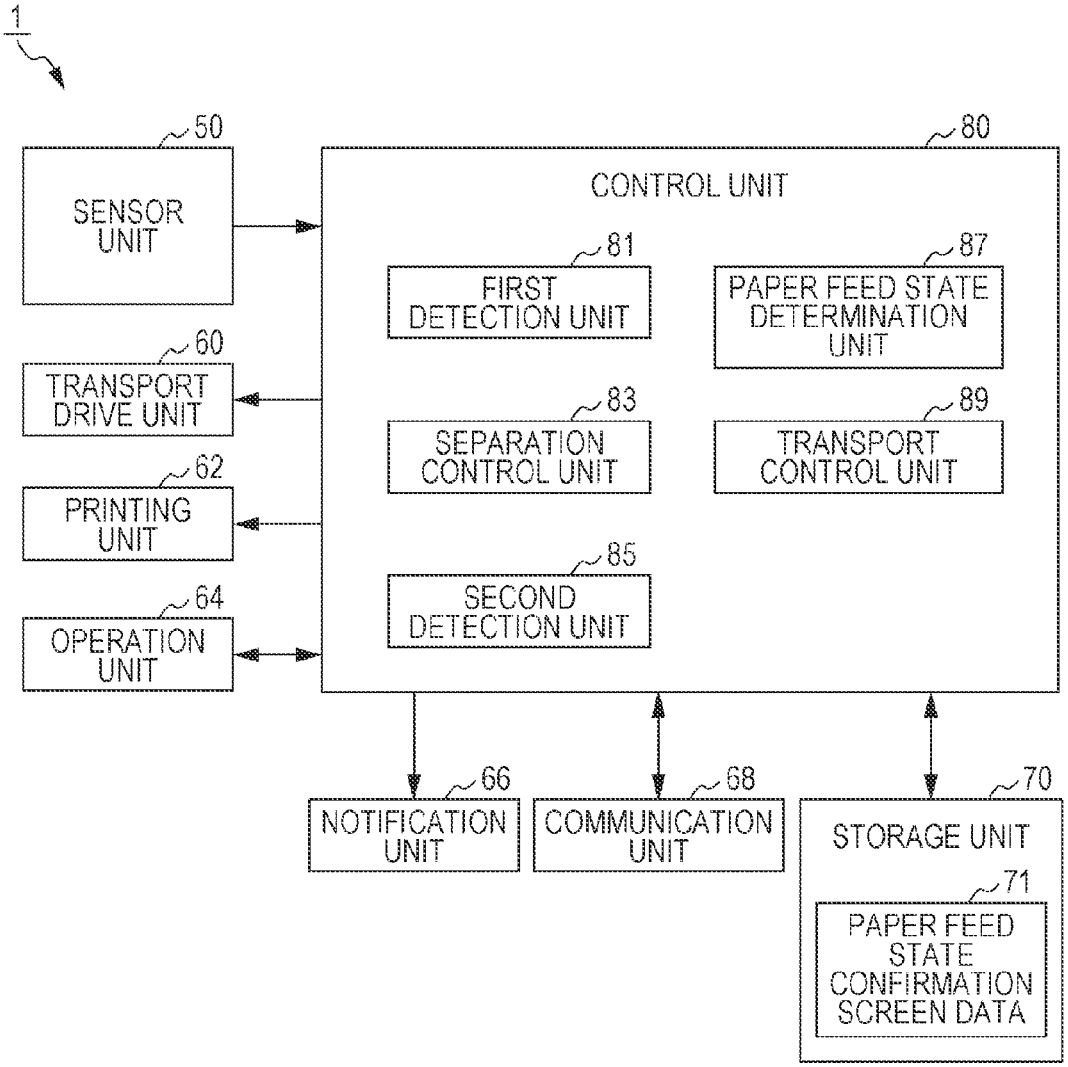
FIG. 3 is a block diagram showing a schematic configuration of the printer.

FIG. 3 is a block diagram showing a schematic configuration of the printer.

The printer 1 includes the sensor unit 50, the transport drive unit 60, the printing unit 62, the operation unit 64, the notification unit 66, the communication unit 68, the storage unit 70, and the control unit 80. Hereinafter, functional units included in the control unit 80 and screen data stored in the storage unit 70 will be described in detail.

The control unit 80 includes functional units such as a first detection unit 81, a separation control unit 83, a second detection unit 85, a paper feed state determination unit 87, and a transport control unit 89. However, these functional units are merely described as an embodiment, and all the functional units are not necessarily required to be essential constituent elements. Further, functional units other than the above may be essential constituent elements.

The first detection unit 81 controls the sensor 3 of the sensor unit 50 and receives a detection signal outputted from the sensor 3. Specifically, the first detection unit 81 supplies power to the sensor 3 and sets various setting values for the sensor 3. As the various setting values, for example, a sampling time (for example, 500 msec) in which sensing is performed by the sensor 3, a predetermined threshold value for detecting the roll paper 2, and the like are set. The first detection unit 81 sets the sensor 3 to be in a detection operating state and sets the sensor 3 to output a detection signal when the roll paper 2 is detected. When the first detection unit 81 receives the detection signal, the first detection unit 81 moves the processing to a functional unit of the separation control unit 83.

The separation control unit 83 controls the transport drive unit 60 and causes the transport rollers 5 to separate from each other. Specifically, the separation control unit 83 rotationally drives a rotating shaft of the cam 8 of the transport drive unit 60. When the rotating shaft of the cam 8 is rotated, the driven roller 7 is moved upward and is separated from the drive roller 6.

The second detection unit 85 controls the sensor 4 of the sensor unit 50 and receives a detection signal outputted from the sensor 4. Specifically, the second detection unit 85 supplies power to the sensor 4 and sets various setting values for the sensor 4. As the various setting values, for example, a sampling time (for example, 500 msec) in which sensing is performed by the sensor 4, a predetermined threshold value for detecting the roll paper 2, and the like are set. The second detection unit 85 sets the sensor 4 to be in a detection operating state and sets the sensor 4 to output a detection signal when the roll paper 2 is detected. When the second detection unit 85 receives the detection signal, the second detection unit 85 moves the processing to a functional unit of the paper feed state determination unit 87.

The timing when the second detection unit 85 sets the sensor 4 to be in a detection operating state may be after the roll paper 2 is detected by the first detection unit 81. It is possible to reduce the power supplied to the sensor 4 by employing the timing described above.

This paper feed state determination unit 87 determines whether or not the roll paper 2 is fed along the paper guide 13. Specifically, the paper feed state determination unit 87 displays paper feed state confirmation screen data 71 (described later in FIG. 4) stored in advance in the storage unit 70 on the notification unit 66 (the operation panel 20). When the paper feed state determination unit 87 obtains an answer indicating that the roll paper 2 is fed along the paper guide 13 from a user who operates the operation unit 64 (the operation panel 20), the paper feed state determination unit 87 returns the processing to the transport control unit 89.

The transport control unit 89 releases the separation between the transport rollers 5 by controlling the transport drive unit 60 and causes the driven roller 7 to come into contact with the drive roller 6 in a state in which the roll paper 2 is pinched. Thereafter, the transport control unit 89 causes the drive roller 6 to rotate. Specifically, the transport control unit 89 rotates the rotating shaft of the cam 8 and moves the driven roller 7 downward. The driven roller 7 pinches the roll paper 2 between the driven roller 7 and the drive roller 6 by the weight of the driven roller 7 and a pressure adjusting spring mechanism. The transport control unit 89 controls a motor that drives the drive roller 6 to rotate the drive roller 6. The roll paper 2 is transported by the rotation of the drive roller 6.

The transport control unit 89 corresponds to a transport unit.

Next, the screen data stored in the storage unit 70 will be described.

Figure 4:
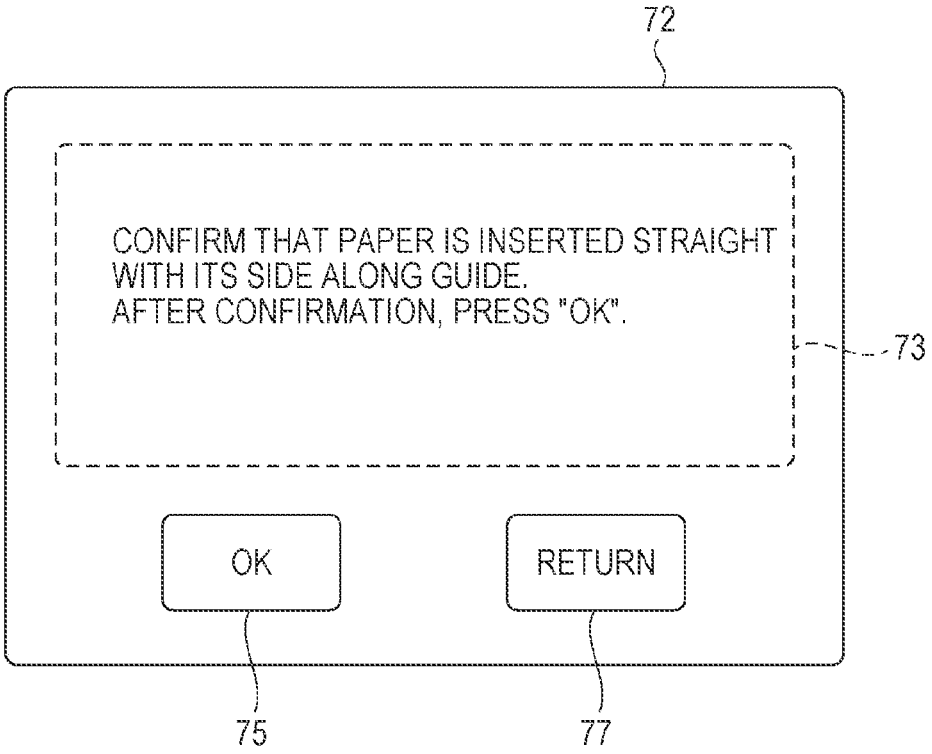
FIG. 4 is a diagram showing an example of a paper feed state confirmation screen.

FIG. 4 is a diagram showing an example of a paper feed state confirmation screen 72. The storage unit 70 stores the paper feed state confirmation screen data 71. The paper feed state confirmation screen 72 represents a screen on which the paper feed state confirmation screen data 71 stored in the storage unit 70 is displayed on the liquid crystal panel of the notification unit 66 (the operation panel 20) by the paper feed state determination unit 87.

The paper feed state confirmation screen 72 has a message display section 73, an OK button 75, and a return button 77.

The message display section 73 is an area in which a message text is displayed and is a screen that notifies a user to confirm whether the roll paper 2 is inserted along the paper guide 13 and to correct the roll paper 2 to be along the paper guide 13 if necessary. Specifically, in the message display section 73, a text "Confirm that paper is inserted straight with its side along guide. After confirmation, press OK." is displayed.

The OK button 75 is a button widget that receives an operation input of the touch panel and has a display of "OK". When the OK button 75 is pressed, a response signal indicating OK is outputted to the paper feed state determination unit 87.

The return button 77 is a button widget that receives an operation input of the touch panel and has a display of "RETURN". When the return button 77 is pressed, a response signal that cancels processing is outputted to the paper feed state determination unit 87.

Flow of Medium Transport Processing

Figure 5:
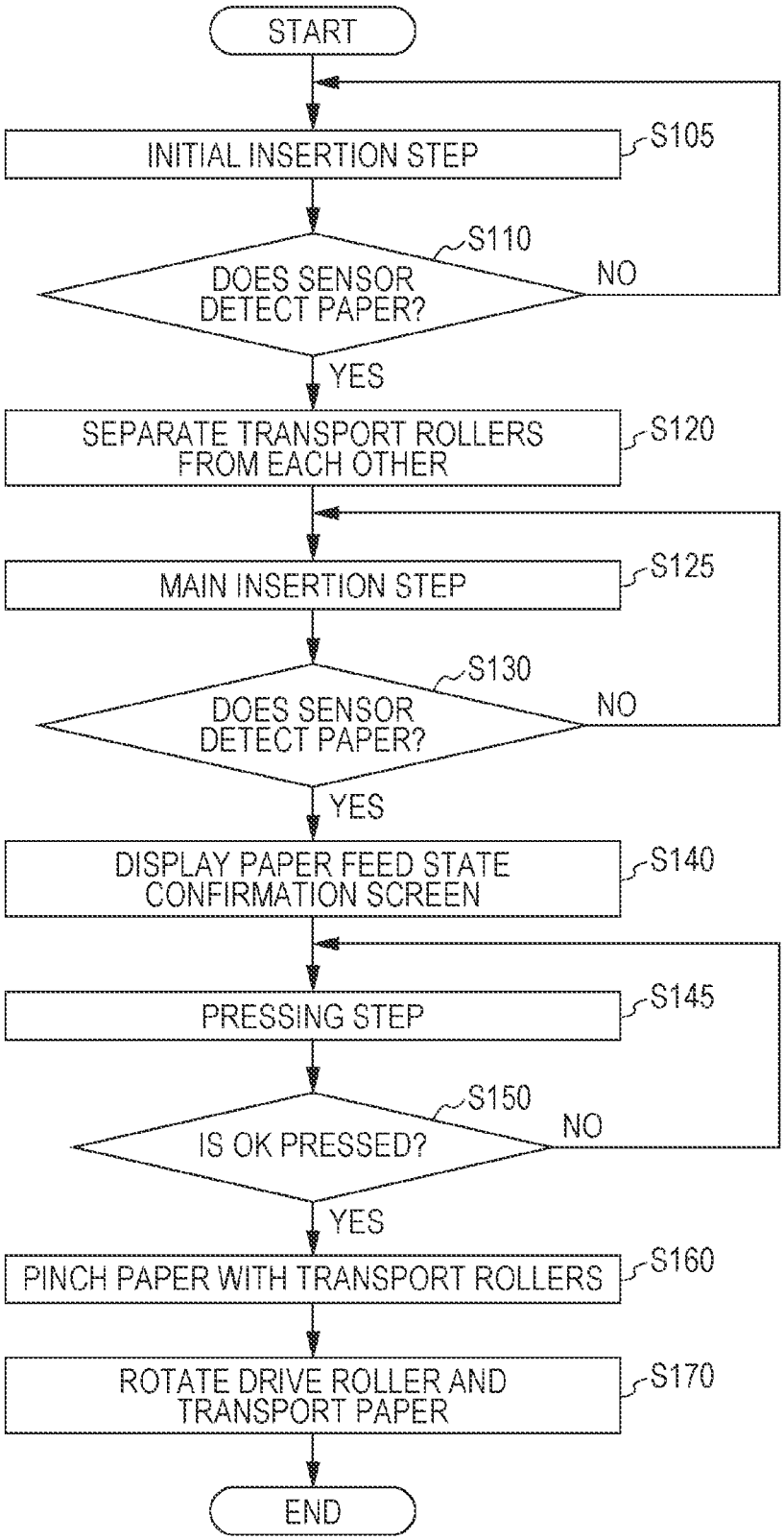
FIG. 5 is a flowchart showing a flow of medium transport processing.

FIG. 5 is a flowchart showing a flow of medium transport processing. The present flow is a flow of processing performed by the control unit 80 that controls units including the sensor unit 50, the transport drive unit 60, the operation unit 64, and the like.

The present flow corresponds to a medium transport method.

Step S105 is an initial insertion step. Specifically, when the rotating part of the roll paper adaptor 11 is rotated, the tip of the paper of the roll paper 2 is sent out. The present step may be manually performed by a user. The present step corresponds to an initial insertion step.

In step S110, whether or not a sensor detects the paper is determined. Specifically, it is determined whether or not a detection signal indicating that the roll paper 2 is detected is inputted from the sensor 3. When the detection signal is inputted (S110; Yes), the process proceeds to the next step S120. When the detection signal is not inputted (S110; No), the process returns to step S105.

When the present step is performed, the function of the first detection unit 81 is realized. The present step corresponds to that the tip of the medium inserted in the initial insertion step is detected.

In step S120, the transport rollers 5 are separated from each other. Specifically, the transport drive unit 60 is controlled so that the cam 8 is rotationally driven and the driven roller 7 is moved upward. The driven roller 7 and the drive roller 6 are separated from each other.

When the present step is performed, the function of the separation control unit 83 is realized. The present step corresponds to an unpinch step.

Step S125 is a main insertion step. Specifically, the tip of the roll paper 2 is sent out, passes through between the transport rollers 5 that are separated from each other, and is inserted into a position of the sensor 4 (the path R4). The present step may be manually performed by a user.

The present step corresponds to a main insertion step. As described above, the position of the sensor 4 (the path R4) corresponds to the predetermined position.

In step S130, whether or not a sensor detects the paper is determined. Specifically, it is determined whether or not a detection signal indicating that the roll paper 2 is detected is inputted from the sensor 4. When the detection signal is inputted (S130; Yes), the process proceeds to the next step S140. When the detection signal is not inputted (S130; No), the process returns to step S125.

When the present step is performed, the function of the second detection unit 85 is realized. The present step corresponds to a determination step.

In step S140, the paper feed state confirmation screen 72 is displayed. Specifically, the paper feed state confirmation screen data 71 is read from the storage unit 70 and the paper feed state confirmation screen data 71 is displayed on the liquid crystal panel of the operation panel 20 by controlling the notification unit 66. The operation unit 64 is controlled to assign areas of the OK button 75 and the return button 77 on the touch panel of the operation panel 20 as areas where pressing the touch panel can be detected.

Step S145 is a pressing step. Specifically, a side end portion of the sent-out roll paper 2 is pressed against the wall surface 13*a* of the paper guide 13. The present step may be manually performed by a user.

The present step corresponds to a pressing step.

In step S150, whether or not the OK button 75 is pressed is determined. Specifically, when the OK button 75 on the paper feed state confirmation screen 72 displayed in step S140 is pressed (S150; Yes), the process proceeds to the next step S160. When neither the OK button 75 nor the return button 77 is pressed (S150; No), the process returns to step S145. When step S140 and step S150 are processed, the function of the paper feed state determination unit 87 is realized. In S150, the determination is performed based on information inputted by a user.

In step S160, the paper is pinched by the transport rollers 5. Specifically, the transport drive unit 60 is controlled so that the cam 8 is rotationally driven and the driven roller 7 is moved downward. The driven roller 7 is caused to come into contact with the drive roller 6 with the roll paper 2 pinched between the driven roller 7 and the drive roller 6.

The present step corresponds to a pinch step.

In step S170, the drive roller 6 is rotated and the paper is transported. Specifically, the transport drive unit 60 is controlled to rotate a motor that drives the drive roller 6. The roll paper 2 pinched in step S160 is transported.

When step S160 and step S170 are processed, the function of the transport control unit 89 is realized.

As described above, according to the printer 1 related to the present embodiment, it is possible to obtain the effects described below.

The control unit 80 determines that the tip of the paper of the roll paper 2 is inserted by receiving the detection signal outputted from the sensor 3. In other words, this is a state in which a user intends to send out and set the paper of the roll paper 2.

In this state, the control unit 80 provides a situation in which the roll paper 2 is reliably fed to the user. This is the separation between the transport rollers 5. It is possible to insert (send out) the tip of the paper of the roll paper 2 deeply into the printer 1 by causing the transport rollers 5 to separate from each other. The size of the separation between the transport rollers 5 is greater than the thickness of the roll paper 2, so that whatever the shape of the tip of the roll paper 2, it is possible to insert (send out) the tip of the roll paper 2 without being affected.

Further, because of the separation between the transport rollers 5, it is possible to adjust the position of the paper by moving the paper in the left-right direction. In other words, by providing such a situation to a user, it is possible to adjust the roll paper 2 in a straight line. As a method of the above, it is recommended to use the paper guide 13 by displaying the paper feed state confirmation screen 72. It is an easy operation for a user to cause a side surface of the roll paper 2 to come into contact with the paper guide 13 in a pressing manner because the transport rollers 5 are separated from each other and the roll paper 2 can be moved in the left-right direction.

When the paper of the roll paper 2 is set according to the instruction of the paper feed state confirmation screen 72 by the paper feed state determination unit 87, a response of the OK button 75 is received and the transport of the roll paper is started by the transport control unit 89.

In this manner, while there has been a risk that a skew occurs when the shape of the tip of the paper of the roll paper is not perpendicular to a side surface of the paper, in the method of the present embodiment, it is possible to provide a medium transport method that can feed a medium while suppressing generation of skew without being affected by the tip shape of the roll paper.

Modified Example 1

While the separation control unit 83 separates the transport rollers 5 from each other in the embodiment described above, it is further possible to drive the drive roller 6. Specifically, by driving and rotating the drive roller 6 while the transport rollers 5 are separate from each other, it is possible to support sending out the paper of the roll paper 2 by a frictional force generated between the roll paper 2 and the drive roller 6.

Further, the drive of the driven drive roller 6 may be stopped after the second detection unit 85 detects the roll paper 2.

By such a configuration, it is possible to reduce a rotation force of manual rotation of the roll paper adaptor 11 performed by a user.

Modified Example 2

In the embodiment and the modified example described above, the paper feed state determination unit 87 determines the paper feed state by displaying the paper feed state confirmation screen 72. However, it is not limited to this configuration. It is possible to employ a configuration in which a sensor is provided on the wall surface 13*a* of the paper guide 13 and it is determined whether or not a side surface of the roll paper 2 is in contact with the paper guide 13 along the paper guide 13 or whether or not the side surface of the roll paper 2 is in parallel with the wall surface 13*a*.

The sensor provided on the wall surface 13*a* may be, for example, a capacitance sensor that detects variation of capacitance charged on the paper of the roll paper 2 or a pressure sensor that detects a contact pressure of a side surface of the paper of the roll paper 2. The sensor may be installed at two or more locations away from each other by a predetermined distance on the wall surface 13*a*.

According to such a configuration, when it is detected that the side surface of the roll paper 2 is along the paper guide 13 by the sensors installed on the wall surface 13*a*, it is possible to omit the display and the confirmation of the paper feed state confirmation screen 72 performed by the paper feed state determination unit 87 because the roll paper 2 is fed without skew.

Modified Example 3

After the transport rollers 5 are separated from each other by the separation control unit 83 of the embodiment and the modified examples described above, it is possible to output audio data indicating to confirm the paper feed state of the roll paper 2 from a speaker by controlling the notification unit 66. According to such a configuration, a user can start an operation to confirm the paper feed state without checking the operation panel 20 every time.

This application claims priority to Japanese Patent Application No. 2014-179916 filed on Sep. 4, 2014. The entire disclosure of Japanese Patent Application No. 2014-179916 is hereby incorporated herein by reference.

What is claimed is:

1. A medium transport method performed by a medium transport device that includes a transport unit which includes rollers that can pinch a medium and which transports the medium and that includes a first sensor located upstream of the rollers and a second sensor located downstream of the rollers, the medium transport method comprising:

inserting the medium into the transport unit;

automatically putting the rollers into an unpinching state after detecting a tip of the medium inserted into the transport unit when the tip of the medium reaches a position of the first sensor:

inserting the medium to a predetermined position after putting the rollers into an unpinching state;

pressing a side end portion of the medium against a wall of a side surface guide after inserting the medium to the predetermined position, wherein the predetermined position is a position of the second sensor; and pinching the medium with the rollers after pressing the side end portion of the medium against the wall of the side surface guide.

2. The medium transport method according to claim 1 further comprising: after inserting the medium to the predetermined position, checking whether the medium is inserted to the predetermined position located more downstream than the rollers.

3. The medium transport method according to claim 2, wherein the checking is performed based on information inputted by a user.

4. The medium transport method according to claim 1, wherein at least one of the inserting the medium to a predetermined position, the inserting the medium into the transport unit, and the pressing a side end portion of the medium against a side surface guide is performed manually by a user.

* * * * *